US005262593A

United States Patent [19]

Madry et al.

[11] Patent Number: 5,262,593

[45] Date of Patent: Nov. 16, 1993

[54] COAXIAL ELECTRICAL HIGH-FREQUENCY CABLE

[75] Inventors: Peter Madry, Barsinghausen; Helmut Hildebrand, Langenhagen, both of Fed. Rep. of Germany

[73] Assignee: Alcatel N.V., Amsterdam, Netherlands

[21] Appl. No.: 845,059

[22] Filed: Mar. 3, 1992

[30] Foreign Application Priority Data

Mar. 9, 1991 [DE] Fed. Rep. of Germany ..... 4107651
Mar. 22, 1991 [DE] Fed. Rep. of Germany ..... 4109491

[51] Int. Cl.[5] ..... H01B 11/18

[52] U.S. Cl. ..... 174/102 R; 174/28; 174/29; 174/102 P; 174/110 A; 174/111

[58] Field of Search ..... 174/102 R, 102 P, 110 A, 174/111, 29, 28

[56] References Cited

U.S. PATENT DOCUMENTS

| | | | |
|---|---|---|---|
| Re. 20,244 | 1/1937 | Peterson | 174/28 |
| 2,092,487 | 9/1937 | Weston | 174/28 |
| 2,348,752 | 5/1944 | Quayle | 174/27 |
| 2,599,857 | 6/1952 | Milaner | 174/29 |
| 3,941,913 | 3/1976 | Buschkamp | 174/23 R |
| 4,018,977 | 4/1977 | Herrmann, Jr. et al. | 174/24 |
| 4,570,678 | 2/1986 | Ziemek et al. | 174/28 X |
| 4,758,685 | 7/1988 | Pote et al. | 174/29 |
| 4,910,998 | 3/1990 | Willis et al. | 174/29 X |

FOREIGN PATENT DOCUMENTS

| | | | |
|---|---|---|---|
| 25751 | 12/1936 | Australia | 174/29 |
| 1127420 | 4/1962 | Fed. Rep. of Germany | 174/29 |
| 3304957 | 8/1984 | Fed. Rep. of Germany . | |
| 1189571 | 10/1959 | France | 174/29 |
| 485946 | 5/1938 | United Kingdom | 174/29 |

*Primary Examiner*—Morris H. Nimmo
*Attorney, Agent, or Firm*—Ware, Fressola, Van Der Sluys & Adolphson

[57] ABSTRACT

In a coaxial electrical high-frequency cable, a spacer is provided between the internal conductor and the external conductor in order to maintain the operation of the cable even in the case of elevated ambient temperatures. The spacer can be a helical profile or of individual shaped pieces made of glass or ceramic materials.

21 Claims, 3 Drawing Sheets

COAXIAL ELECTRICAL HIGH-FREQUENCY CABLE

BACKGROUND OF THE INVENTION

1. Field of the Invention

The present invention relates to a coaxial electrical high-frequency cable with spacing means arranged between the internal and external conductors.

2. Description of the Prior Art

A coaxial high-frequency power cable is already known, in which a spacing is provided between the internal conductor and external conductor which is made of individual pieces consisting of ceramic. These individual pieces are arranged on the internal conductor staggered with respect to each other and individually screwed to the internal conductor (German Patent Application DE-OS 33 04 957). Although such a known cable is suitable for being largely operative under extreme conditions such as at the elevated ambient temperatures encountered during a fire, this design is very expensive in terms of production engineering. In addition, the fastening screws used to fasten the individual pieces to the internal conductor are frequently undesirable for electrical reasons.

SUMMARY OF THE INVENTION

Starting from the state of the art, an object of the invention is to create a coaxial high-frequency cable which is operative even under extreme conditions such as a fire, has low manufacturing costs and is free of additional materials, particularly metals, in the dielectric that have a harmful effect on the transmission quality.

According to the invention, the cable is provided with a spacer having a helical profile, consisting of glass or ceramic materials, or predominantly contains these materials. A helical profile of this type can be applied with the customary machine systems presently available in cable technology, and electrical effect on the transmission properties by foreign materials is eliminated, and the cable according to the invention is operable under the extreme conditions of a fire. This is particularly advantageous, for example, in supplying power to an emergency call transmitter or a radiating high-frequency cable used for control or message purposes, such as is used for train monitoring, where the cable is arranged in a tunnel. It is also useful for supply or control cables that are installed on off-shore oil platforms and must be operable even in the event of a fire.

The same advantages are obtained in another embodiment of the invention, in which the spacers are ceramic shaped pieces, which are held on the internal conductor by virtue of their shape.

The helical profile made of refractory materials according to the invention can have any form, for example, it can be a profile strand, which is placed helically around the internal conductor of the high-frequency cable. In order to maintain a large air space between the internal and the external conductor of the fire-protected cable, the profile strand can be made up of braided individual strands of circular cross-section or of individual fibers. Several such profiles can, in turn, be stranded or braided with each other, for example, when it is desirable to bridge major distances between the internal and external conductors of the cable without disadvantageously affecting the flexibility of the cable.

In certain situations, it may also be advantageous to provide an additional refractory coating if the helical profiles are made of the refractory materials. The additional refractory coating could be in the form of a braiding or woven fabric. Such an additional refractory coating is particularly advantageous when the helix is formed of individual strands stranded or knitted with each other.

In another embodiment of the invention, the helical profile is provided by a plurality of profile bodies made of the glass or ceramic materials arranged in series on a support. The profile bodies themselves can be spheres, rollers or rolls which are fastened on an appropriate refractory support fiber or strand or have refractory fibers braided around them.

If, as is also provided according to the invention, ceramic shaped pieces are used instead of the helical profile described, then these will be advantageously mountable to the internal conductor. Profile bodies of this type can be, for example, hollow cylinders with longitudinal slots leading from the ends to the center and displaced with respect to each other by more than 90°. A preferable structure is one in which the longitudinal slots are displaced with respect to each other by 180°. This means that the profile bodies, which are prefabricated elements, are mounted in a transverse direction on the internal conductor of the coaxial high-frequency cable and are then rotated into alignment with the longitudinal axis of the cable. Once mounted in this fashion, the position of the profile body on the internal conductor can be fixed by the external conductor of the cable.

Another embodiment of the shaped pieces is provided by radially-slotted disc-shaped spacers which are mounted transversely on the internal conductor, in which case it may be appropriate for the stability of these spacers on the internal conductor, to rotate adjacent discs uniformly with respect to each other. The spacers thus reliably hold the internal conductor in its central position and are finally fixed in their position on the internal conductor by means of the external conductor.

Another appropriate form of the invention is obtained when the shaped pieces are injection-molded pieces completely surrounding the internal conductor. As in the case of other known cable constructions of the above-mentioned type, in which discs of plastic are sprayed discontinuously onto the internal conductor during manufacture, in the execution of the invention, for production of the ceramic injection molded pieces, an injection molding machine filled with the appropriate ceramic mass can be used to initially spray the spacers in disc form onto the internal conductor passing through. Following this, each disc is sintered, hardened or otherwise optionally finished. The usual further processing of internal conductors prepared in this manner and provided with the spacers to produce a cable can then be carried out in a known manner.

As a material for the spacers according to the invention, known ceramics, in addition to glass, can be used. Such ceramics are also optionally permeated by glass fibers for mechanical reinforcement purposes. Also suitable in this connection are foamed ceramics, such as are known, for example, under the trademark POROTON. Since these materials are hygroscopic, it is recommended that the shaped pieces be provided after sintering with a moisture-repellant coating in the form of a varnish or a glaze.

As already mentioned, the refractory cables according to the invention find a particularly advantageous use in the form of so-called radiating high-frequency cables, i.e., coaxial electrical cables whose outside conductors contain regular openings in the form of slots, holes, recesses and the like. If the external conductors are metal foils that are placed around the refractory spacers in a longitudinal manner, then these, as a rule, are not self-supporting, particularly if the tape edges leave a free longitudinal slot between them. In these or similar cases, it has therefore proven appropriate to fill the spaces between the internal and external conductors free of the spacers completely or in part with an insulating material. For a refractory product, the insulating material is then advantageously covered by a refractory foil or a tape, i.e., a glass-mica tape. Alternatively, the refractory spacers, helical profiles or shaped bodies according to the invention can be surrounded with a plastic tube, which is covered toward the outside by a refractory foil or an appropriate tape. The external conductor of the cable, also in a non-self-supporting form, is then arranged above this.

However, even for cables with a self-supporting external conductor, where supporting elements in the form of insulating materials, such as a supporting tube, can thus be dispensed with, it may frequently be advantageous to surround the spacers, helical profile or shaped bodies with a closed layer of a refractory foil or a corresponding tape. This measure is of particular importance when the self-supporting external conductor is later provided with slots or holes and there is a danger that metal splinters, shavings and the like could pass into the dielectric.

BRIEF DESCRIPTION OF THE DRAWINGS

The invention will be explained in greater detail with reference to the embodiments shown in FIGS. 1–10.

DETAILED DESCRIPTION OF THE INVENTION

Figure 1:
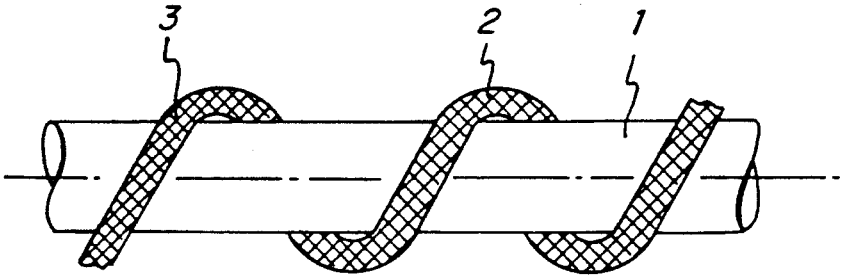
FIGS. 1 through 7 are side elevational views of seven different embodiments of the present cable invention with their outer portions removed to illustrate internal structure.

In FIG. 1, an internal conductor 1 of a coaxial high-frequency cable has a helix 2 placed therearound. The helix 2 is a glass cord of simple glass yarn, which is stranded, twisted or braided, in order to arrive at the cross-sectional dimensions required for a specific spacing between the internal and external conductors. This glass cord, as is indicated schematically, is surrounded by an outer braiding 3, for example, to increase the mechanical strength of a helical profile of this type.

Figure 2:
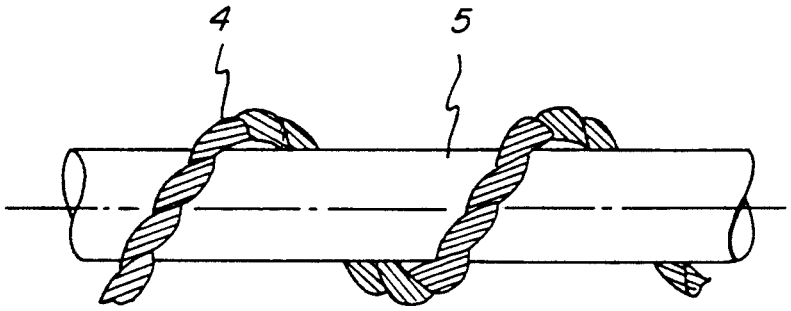

If, for example, large distances between the internal and external conductors of the high-frequency cables have to be bridged, then, in accordance with FIG. 2, it is also possible to group together several of the cords shown in FIG. 1, with or without braiding, to form a strand of larger cross-section. For this purpose, for example, in accordance with FIG. 2, three individual cords 2 are stranded or knitted together to form the shaped strand 4, which then, in turn, is applied to the internal conductor 5 of the high-frequency cable as a spacer for the concentric external conductor.

It is important for the invention that, in contrast to previously conventional spacers made exclusively from polymeric materials, the materials used withstand elevated temperatures and do not melt, so that the operating properties of the cable are retained, at least for a certain time, even in the event of a fire.

Figure 3:
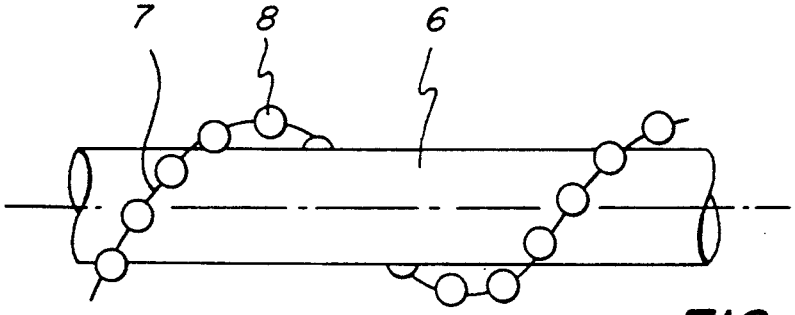

In addition to the helical profiles described in FIGS. 1 and 2, embodiments such as are exemplified in FIG. 3 are therefore also suitable. In FIG. 3, for example, spherical glass or ceramic bodies 8 are fastened on or to a support fiber 7. This combination is placed as a helix around the internal conductor 6 to maintain the spacing of the external conductor (not shown).

Figure 4:
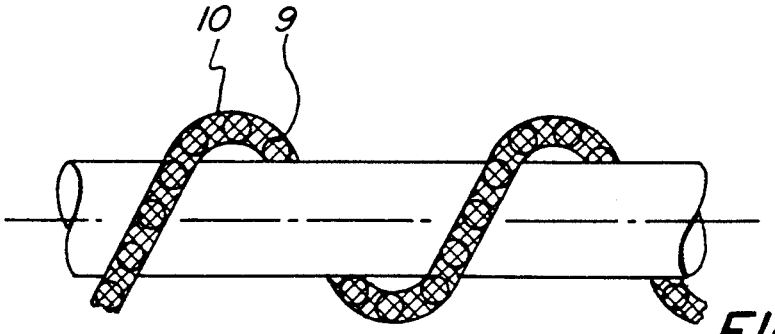

As an alternative to this, FIG. 4 shows a helical spacer, provided by spherically shaped glass or ceramic bodies 9, which, in turn, is surrounded by a braiding 10 of glass or ceramic fibers.

The areas between the internal conductor and external conductor (not shown) of the high-frequency cable free of the spacers can, particularly if the external conductor is no self-supporting, i.e., if it is, for example, a metal tape placed around the spacers, be filled with the customary materials, for example, with materials formed of polyethylene foam or other extrudable materials.

As already explained, coaxial high-frequency cable is, for example, also used in supplying an emergency call transmitter or as a high-frequency cable used for control or message purposes. Such cable is used for monitoring trains and is located in tunnels. Cables of this type must still be operable if, after the outbreak of a fire, high ambient temperatures appear in the vicinity of the cable. While the operating properties of the known cables with spacers made of polymeric materials is not assured, because the spacers between the internal and external conductors melt at elevated temperatures, the spacers made of ceramic materials provided according to the invention assure that, even in the event of a fire, the spacing between the internal and external conductor required for cable operation is maintained.

Figure 5:
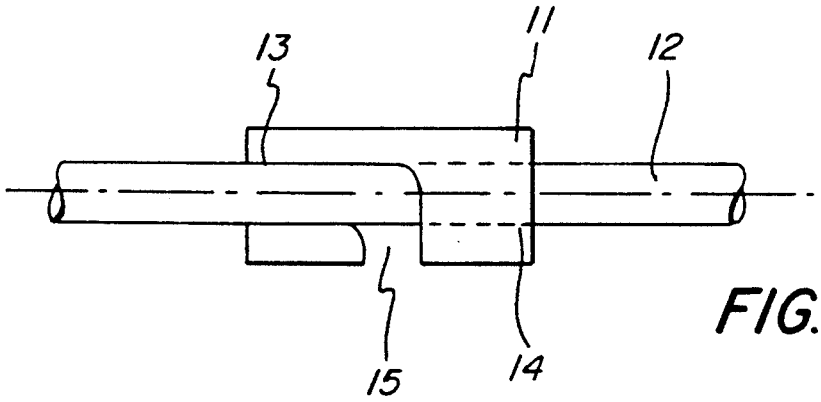

To provide reliable operation of the cable even at elevated temperatures encountered during a fire, the FIG. 5 embodiment includes a hollow cylindrical shaped piece 11 serving as a spacer, fastened to an internal conductor 12 of the high-frequency cable. In order to achieve this, the shaped piece 11 defines two longitudinal slots 13 and 14 running from the ends to the center. The slots 13, 14 end in a central recess 15. By means of the longitudinal slots 13, 14 and the central recess 15, it is possible to mount the shaped piece 11 transversely on the internal conductor and then, by rotation to align the shaped piece 11 in the axial direction of the internal conductor 12, to bring it into the position shown. Internal conductors prepared in this way, i.e., already equipped with the spacers, can then, in the usual manner, be surrounded by the external conductor in the form of a longitudinal copper band or a corrugated tube. The external conductor is applied to the shaped pieces 11 concentrically with the internal conductor 12.

Figure 6:
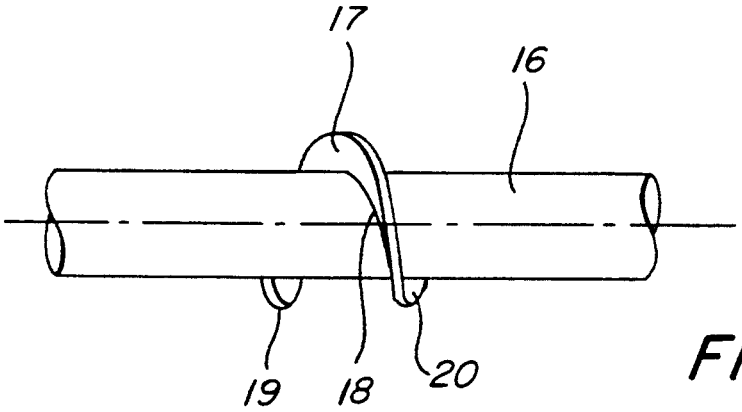

Turning now to FIG. 6, an embodiment of the invention is shown in which disc-shaped spacers 17 (only one shown) are mounted on the internal conductor 16 of the refractory coaxial high-frequency cable. Each spacer 17 has a slot or opening 18, which is appropriate for the size of the internal conductor 16. The ends 19 and 20 of the spacer 17 formed by the slot or opening 18 are staggered in the direction of the internal conductor 16. This holds the spacer 17 securely on the internal conductor of the high-frequency cable.

Figure 7:
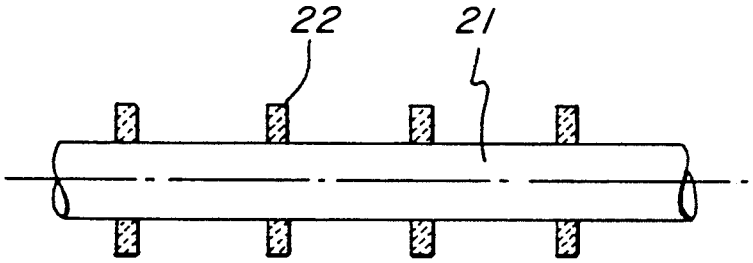

A further embodiment of the present invention is shown in FIG. 7. Here, disc-shaped spacers 22 are applied to the internal conductor 21 of the refractory high-frequency cable at intervals. The spacers 22 completely surround the internal conductor 21 and are applied by a spraying or injection-molding process. For this purpose, one can use known techniques to apply the spacers 22, such as simultaneously spraying a plurality of these disc-shaped spacers 22 onto the internal conductor 21. The thus formed spacers 22 are then sintered or hardened and possibly after-treated, while, at the same time but in a discontinuous process, an equal number of new shaped pieces is sprayed onto the internal conductor 21 at a different location.

In the event that the ceramic material used for the spacers according to FIGS. 5–7 is too hygroscopic to guarantee the required transmission properties of the cable according to the invention, the profile bodies already prefabricated according to FIGS. 5 and 6, and the profile bodies fastened to the internal conductor by a spray process according to FIG. 7, can be provided with a suitable coating. The profile bodies of FIGS. 5 and 6 can be provided with such a coating before or after the application thereof to the internal conductor.

Figure 8:
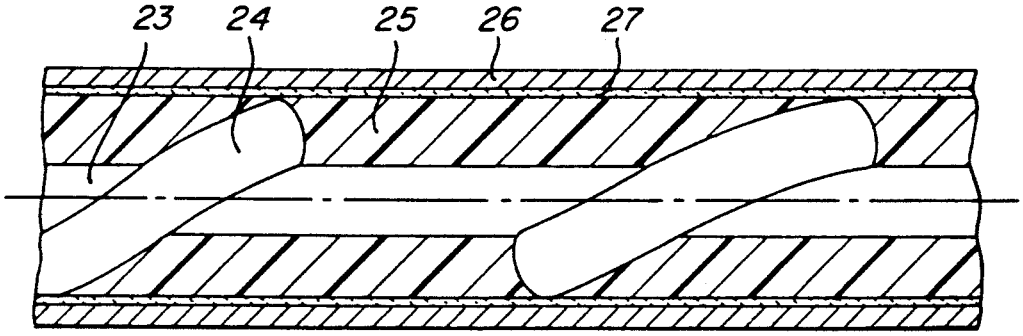
FIGS. 8 through 10 are side elevational views of three different embodiments of the present cable invention with the outer portions broken away to illustrate internal structure.
Figure 9:
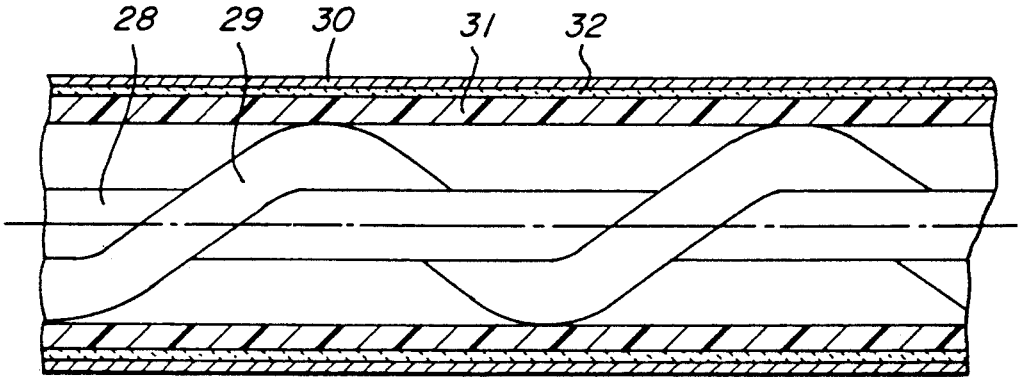

Several embodiments for a high-frequency cable according to the invention with an external conductor that is not dimensionally stable are shown in FIGS. 8 and 9.

According to FIG. 8, the internal conductor 23 is surrounded by the helix 24 of refractory material and the spaces between the winds of the helix 24 are filled, for example, with polyethylene foam 25. This insulating material simultaneously serves as a support for the external conductor 26, which is, for example, a slotted metal foil. In order to prevent an escape of molten polyethylene from the external conductors 26 in the event of a fire during which high temperatures prevail, a layer 27 is located between the insulating polyethylene 25 and the external conductor 26. The layer 27 can be one or several strata of a refractory band, such as a mica-coated band of glass fabric.

As an alternative to the embodiment according to FIG. 8, FIG. 9 shows a cable design in which the external conductor 30 is not dimensionally stable. An internal conductor 28 is surrounded by a helix 29 of refractory material, and the support of the external conductor 30 is provided by the extruded plastic tube 31 made of a suitable polyethylene. To assure that, at elevated ambient temperatures, molten polyethylene will not seep through radiation openings (not shown) in the external conductor 30, a refractory layer 32 is provided between the plastic tube 31 and the external conductor 30. The layer 32 can be a closed set of mica or glass-fabric tapes.

Figure 10:
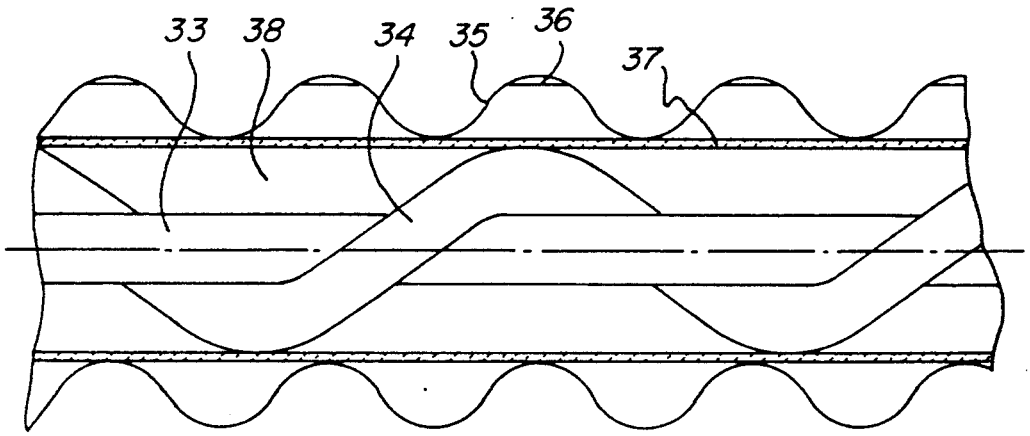

Finally, in FIG. 10, a cable according to the invention with the property of radiating high-frequency signals and with a self-supporting external conductor is shown. A helix 34 of refractory material surrounds an internal conductor 33. On the helix 34 there is supported an external conductor 35 in the form of a closed and corrugated metal sheath. The metal sheath has radiation openings 36 which are produced later by milling along the surface of the external conductor 35. According to the invention, one or more layers 37 of mica tapes or coated glass-fabric tapes can be provided between the helix 34 and external conductor 35 to prevent the penetration of the metal residues formed during the production of the radiation openings 36 into the space 38 between the internal conductor 33 and the external conductor 35.

In the embodiments of FIGS. 8–10, it is, of course, possible to use the spacing shaped bodies according to FIGS. 5–7 instead of the refractory helices. The important feature of the invention is that, in the case of elevated ambient temperatures, e.g., in the event of a fire, the transmission of high-frequency signals is possible.

Thus, it can be seen from the foregoing specification and attached drawings that the present invention provides a unique means for maintaining the operation of the cable even in the event of elevated ambient temperatures caused by a fire or the like.

The invention as described above admirably achieves the objects of the invention; however, it will be appreciated that the departures can be made by those skilled in the art without departing from the spirit and scope of the invention, which is limited only by the following claims.

What is claimed is:

1. A coaxial electrical high-frequency cable comprising:

an internal conductor;

an external conductor; and spacing means having a helical profile and being made predominantly of dielectric materials, wherein areas between the internal and external conductors free of the spacing means are at least partially filled with an insulating material, the insulating material is covered by a refractory material.

2. A high-frequency cable according to claim 1, wherein the helical profile is provided by braided strands.

3. A high-frequency cable according to claim 2, wherein the helical profile is surrounded by a braiding.

4. A high-frequency cable according to claim 1, wherein the helical profile is surrounded by a braiding.

5. A high-frequency cable according to claim 1, wherein the helical profile includes a plurality of profile bodies made of dielectric materials arranged consecutively on a support.

6. A high-frequency cable according to claim 1, wherein said dielectric material is glass.

7. A high-frequency cable according to claim 1, wherein said dielectric material is ceramic.

8. A coaxial electrical high-frequency cable comprising:

an internal conductor;

an external conductor; and spacing means having a helical profile and being made predominantly of dielectric materials, wherein the helical profile includes a plurality of profile bodies, around which glass or ceramic fibers are braided or spun.

9. A high-frequency cable according to claim 8, wherein the profile bodies have a spherical shape.

10. A coaxial electrical high-frequency cable comprising:

an internal conductor;

an external conductor; and spacing means having a helical profile and being made predominantly of dielectric materials, wherein the spacing means is surrounded by a plastic tube which is covered on its outer portion by a refractory material.

11. A coaxial electrical high-frequency cable comprising:

an internal conductor;

an external conductor; and spacing means having a helical profile and being made predominantly of dielectric materials, wherein the spacing means is surrounded by a closed layer of a refractory material.

12. A high-frequency cable according to claim 11, wherein the layer of refractory material is surrounded by a self-supporting external conductor in the form of a corrugated metal sheath with openings defined therein.

13. A coaxial electrical high-frequency cable comprising:

an internal conductor;

an external conductor; and spacing means arranged between the internal and external conductors, the spacing means are shaped pieces made of ceramic material held on the internal conductor by virtue of their shape, wherein the shaped pieces are profile bodies mounted transversely on the internal conductor, the profile bodies are hollow cylinders with longitudinal slots leading from their ends to their centers, said longitudinal slots in each profile body being displaced with respect to each other by more than 90°.

14. A coaxial electrical high-frequency cable comprising:

an internal conductor;

an external conductor; and spacing means arranged between the internal and external conductors, the spacing means are shaped pieces made of ceramic material held on the internal conductor by virtue of their shape, wherein areas between the internal and external conductors free of the spacing means are at least partially filled with an insulating material.

15. A high-frequency cable according to claim 14, wherein the insulating material is covered by a refractory material.

16. A high-frequency cable according to claim 14, wherein the shaped pieces are discs, each disc has a radial slot.

17. A high-frequency cable according to claim 16, wherein ends formed by the radial slot in each disc are displaced in the axial direction of the internal conductor.

18. A high-frequency cable according to claim 14, wherein the shaped pieces are injection-molded pieces completely surrounding the internal conductor.

19. A coaxial electrical high-frequency cable comprising:

an internal conductor;

an external conductor; and spacing means arranged between the internal and external conductors, the spacing means are shaped pieces made of ceramic material held on the internal conductor by virtue of their shape, wherein the spacing means is surrounded by a plastic tube which is covered on its outer portion by a refractory material.

20. A coaxial electrical high-frequency cable comprising:

an internal conductor;

an external conductor; and spacing means arranged between the internal and external conductors, the spacing means are shaped pieces made of ceramic material held on the internal conductor by virtue of their shape, wherein the spacing means is surrounded by a closed layer of a refractory material.

21. A high-frequency cable according to claim 20, wherein the layer of refractory material is surrounded by a self-supporting external conductor in the form of a corrugated metal sheath with openings defined therein.

* * * * *